US007153167B1

(12) United States Patent
Switzer

(10) Patent No.: US 7,153,167 B1
(45) Date of Patent: Dec. 26, 2006

(54) RECESSED LIGHT EXTENSION SOCKET

(75) Inventor: Calvin T. Switzer, Castle Rock, CO (US)

(73) Assignee: Ideawerks, LLC, Castle Rock, CO (US)

( * ) Notice: Subject to any disclaimer, the term of this patent is extended or adjusted under 35 U.S.C. 154(b) by 0 days.

(21) Appl. No.: 11/056,178

(22) Filed: Feb. 10, 2005

(51) Int. Cl.
*H01R 33/94* (2006.01)

(52) U.S. Cl. ..... 439/642; 439/537

(58) Field of Classification Search ..... 439/313, 439/334, 361, 502, 537, 576, 642, 643, 664, 439/810, 814
See application file for complete search history.

(56) References Cited

U.S. PATENT DOCUMENTS

| | | | | |
|---|---|---|---|---|
| 394,680 | A | 12/1888 | Dawes | |
| 684,264 | A | 10/1901 | Kemmerer et al. | |
| 806,516 | A | 12/1905 | Berry | |
| 866,473 | A | 9/1907 | Keefe et al. | |
| 1,263,783 | A | 4/1918 | Maler | |
| 1,297,211 | A | 3/1919 | Magness | |
| 1,348,949 | A | 8/1920 | Johansson | |
| 1,934,624 | A | 11/1933 | Guth | |
| 2,115,898 | A | 5/1938 | Zagora | |
| 2,217,533 | A | 10/1940 | Wolarsky | |
| 2,446,736 | A | 8/1948 | Biller | |
| 2,753,445 | A | 7/1956 | Thomas et al. | |
| 2,767,953 | A | 10/1956 | Wolar | |
| 4,039,821 | A * | 8/1977 | Greene et al. | 362/217 |
| 4,223,179 | A * | 9/1980 | Lusk et al. | 174/73.1 |
| 4,407,560 | A * | 10/1983 | Williams | 439/642 |
| D298,657 | S | 11/1988 | Flores | |
| 4,783,726 | A * | 11/1988 | Wang | 362/252 |
| 5,257,172 | A | 10/1993 | Erickson | |
| 5,317,493 | A | 5/1994 | Muller et al. | |
| 6,113,433 | A | 9/2000 | Al-Turki | |
| 6,305,974 | B1 * | 10/2001 | Tseng | 439/537 |
| 6,409,365 | B1 | 6/2002 | Lin | |
| 6,474,829 | B1 | 11/2002 | Clodfelter | |
| 6,523,970 | B1 * | 2/2003 | Scales, III | 362/145 |
| 6,997,740 | B1 * | 2/2006 | Kerr | 439/537 |
| 2003/0161149 | A1 | 8/2003 | Eaton, Jr. | |
| 2003/0235049 | A1 | 12/2003 | Wu | |

OTHER PUBLICATIONS

Hampton Bay, Track Light Accessory, A25 "Recessed to Track Converter" 2 pages;465 036. (see attached photocopy).

* cited by examiner

*Primary Examiner*—Thanh-Tam Le
(74) *Attorney, Agent, or Firm*—Rick Martin; Patent Law Offices of Rick Martin, PC

(57) ABSTRACT

A standard ceiling recessed lighting fixture can be modified to a low-slung AC or DC light fixture with a screw-in extension rod. The extension rod with bulb can be used to light a restaurant table or a pool table or a workbench and the like. A series of extension rods can be screwed together for a desired length.

10 Claims, 9 Drawing Sheets

Fig. 1
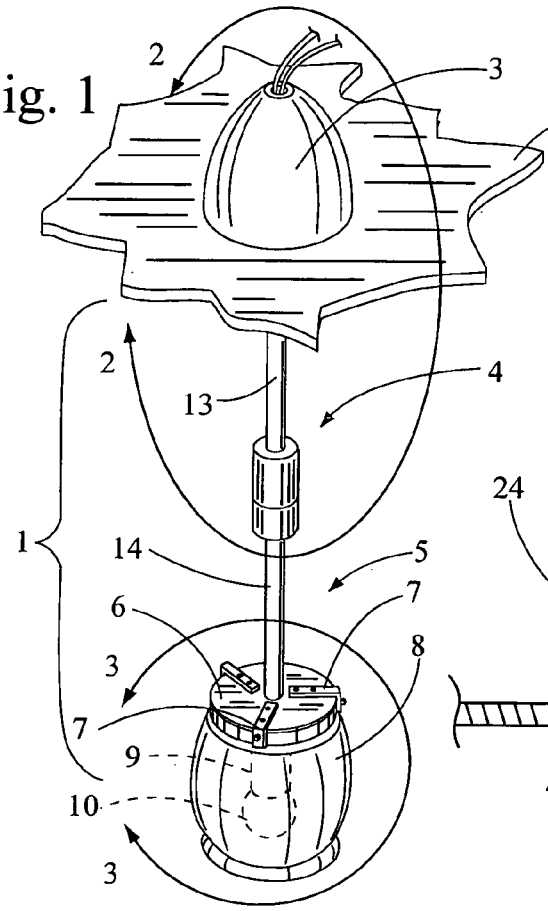
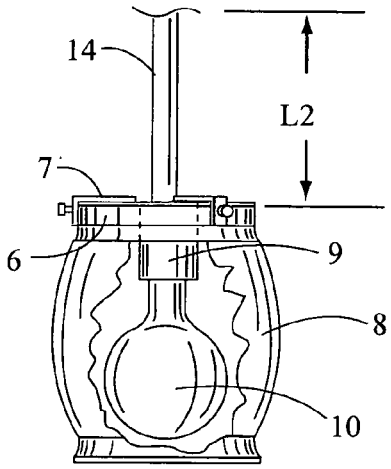
Fig. 3
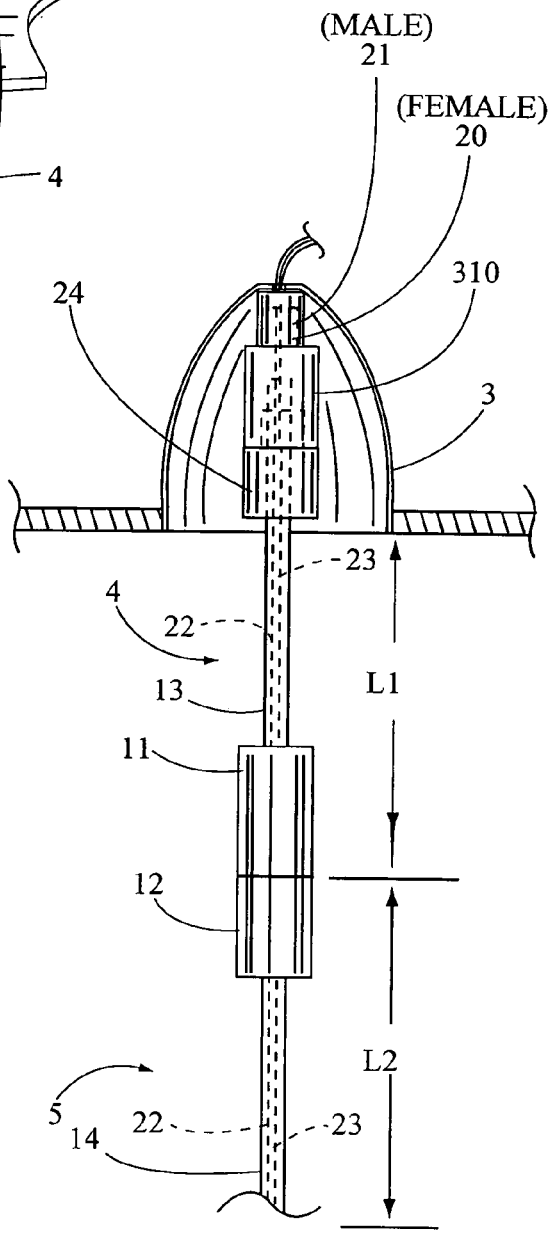
Fig. 2

RECESSED LIGHT EXTENSION SOCKET

FIELD OF INVENTION

The present invention relates to starting with a standard ceiling recessed lighting fixture and screwing in an extension rod to provide a socket lower (perhaps by several feet) than the ceiling, for example to better illuminate a restaurant table.

BACKGROUND OF THE INVENTION

It is known to screw an electric adapter into a standard ceiling recessed fixture. Hampton Bay™ provides an adapter male plug that screws into the ceiling light fixture. It powers a track fixture head which mounts to a canopy that covers the original ceiling light fixture. A standard track light fixture snaps into the track fixture head.

U.S. Pat. No. 6,113,433 (2000) Al-Turki discloses a one to two bulb AC ceiling light fixture adapter. The two-bulb extension receives one threaded bulb and one bayonet bulb.

A brief summary of related art follows below:

Hampton Bay™ sells a light fixture extension which allows a halogen light fixture to be powered by a standard ceiling light bulb fixture.

U.S. Pat. No. 394,680 (1888) to Dawes discloses a ceiling mounted rod that swivels and to which is attached a power cord and light bulb fixture.

U.S. Pat. No. 684,264 (1901) to Kemmerer discloses a ceiling mounted rod that swivels and supports a bulb fixture at its end.

U.S. Pat. No. 806,516 (1905) to Berry discloses a ceiling mounted two-piece swiveling rod fixture for a bulb fixture.

U.S. Pat. No. 866,473 (1907) to Keefe et al. discloses a ceiling fixture with a swiveling rod and a wire coil end for a bulb fixture.

U.S. Pat. No. 1,263,783 (1918) to Maier discloses a ceiling fixture with a swiveling rod.

U.S. Pat. No. 1,297,211 (1919) to Magress discloses a ceiling fixture with a swiveling rod.

U.S. Pat. No. 1,348,949 (1920) to Johansson discloses a ceiling fixture with a swiveling rod.

U.S. Pat. No. 1,934,624 (1933) to Guth discloses a flexible stem on a ceiling fixture.

U.S. Pat. No. 2,115,898 (1938) to Zagora discloses a swivel-type rod ceiling fixture.

U.S. Pat. No. 2,217,533 (1940) to Wolarsky discloses a telescoping rod light fixture.

U.S. Pat. No. 2,446,736 (1948) to Biller discloses a suspension support for fluorescent lights.

U.S. Pat. No. 2,753,445 (1956) to Thomas et al. discloses a ceiling fixture with a stem.

U.S. Pat. No. 2,767,953 (1956) to Wolar discloses a ceiling fixture and canopy support.

U.S. Pat. No. 5,257,172 (1993) to Erickson discloses a portable AC trouble light.

U.S. Pat. No. 5,317,493 (1994) to Muller et al. discloses an inclined ceiling light fixture.

U.S. Pat. No. 6,113,433 (2000) to Al-Turki discloses an adapter that screws into a bulb socket and has multiple sockets in it.

U.S. Pat. No. 6,409,365 (2002) to Lin discloses a hanging fixture.

U.S. Pat. No. 6,474,829 (2002) to Clodfelter discloses a receptacle mounted light fixture.

U.S. patent No. Des. 298,657 (1988) to Flores discloses a dual-ended extension cord.

U.S. Patent No. 2003/0235049 discloses a decoration multi-bulb fixture.

U.S. Patent No. 2003/0161149 discloses a collar for a ceiling fixture to enable an extended length bulb to have a diffuser.

What the prior art doesn't suggest is a rod-like extender to lower a socket from the ceiling, for example, to a few feet above a restaurant table or a pool table. The present invention provides such a simple, screw-in type extension rod for light bulb sockets. Although the preferred embodiment shows use with a ceiling mounted recessed type lighting fixture, any threaded lighting socket can be used with the present invention.

SUMMARY OF THE INVENTION

An aspect of the present invention is to provide an easy-to-install rod into a screw type (Edison type bulb or other) socket, thereby extending an Edison socket (or if desired a Bayonet or other type socket) several feet away from the original socket.

Another aspect of the present invention is to provide a mating capability among a series of the extension rods.

Another aspect of the present invention is to provide a shroud over the extended light socket.

Another aspect of the present invention is to provide for either a rigid rod or a flexible extension.

Another aspect of the present invention is to provide a line voltage to low voltage converter in certain embodiments Other aspects of this invention will appear from the following description and appended claims, reference being made to the accompanying drawings forming a part of this specification wherein like reference characters designate corresponding parts in the several views.

The AC to AC embodiment provides a male adapter to go into a female socket, nominally in a ceiling mounted recessed light fixture. A rigid rod extends from the adapter housing to two AC wires. The wires are electrically connected internally to a female socket at the opposite end of the extension rod. A light shroud is attached over the female socket. A flexible rod or wire embodiment has a strain relief cable inside the flexible rod or wire to hold the weight of the female socket, bulb, and shroud. Multiple rods, either solid or flexible, can be screwed together.

A line voltage to low voltage system adds a transformer at the ceiling end of the extension rod. Twelve-volt bulbs can be used.

BRIEF DESCRIPTION OF THE DRAWINGS

FIG. 1 is a top perspective view of a ceiling recessed light fixture with an AC/transformer extension adapter installed.

FIG. 2 is a side partial cutaway view of the FIG. 1 embodiment.

FIG. 3 is a partial cutaway view of the lowered bulb of FIG. 1.

Figure 4:
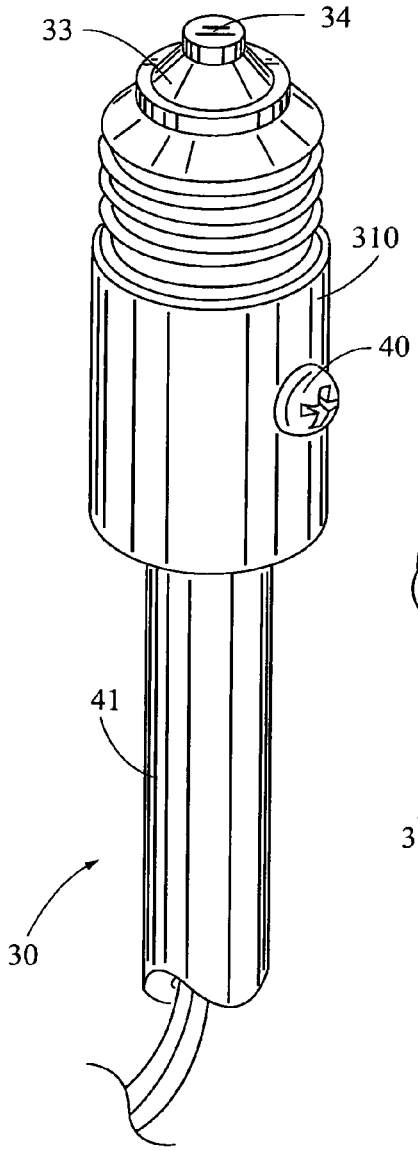
FIG. 4 is a top perspective view of a male adapter.
Figure 5:
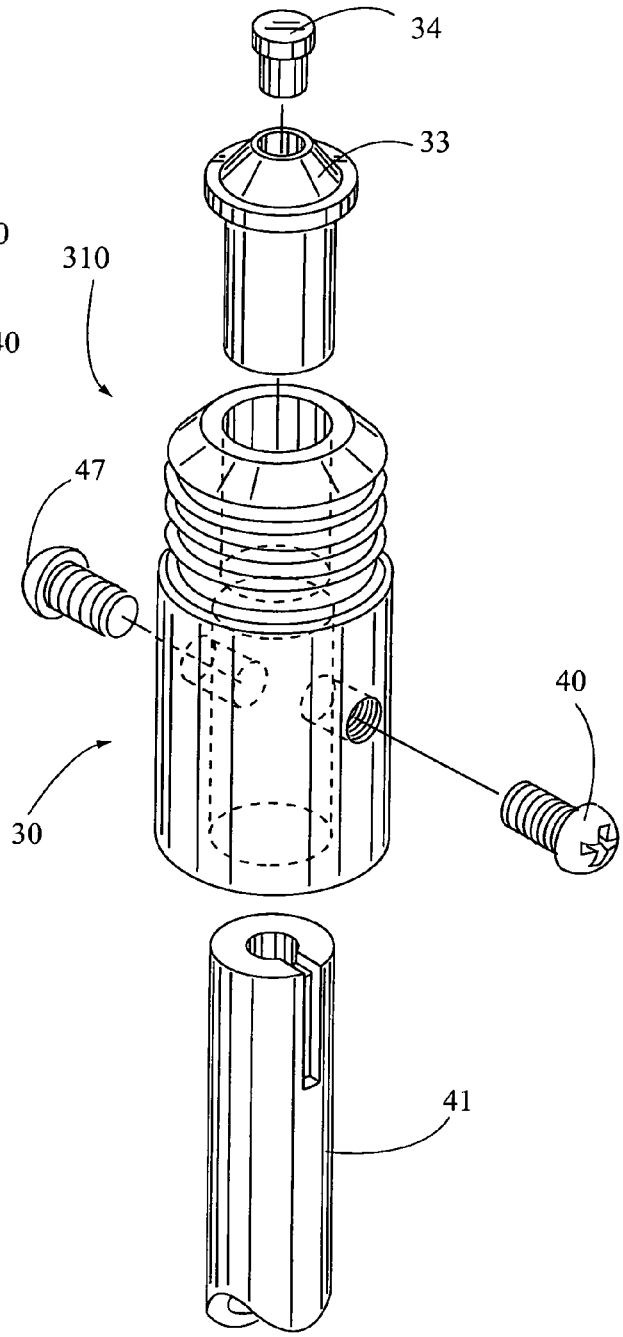
FIG. 5 is an exploded view of FIG. 4, without the two wires.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Referring first to FIGS. 1,2 a line voltage to low voltage extension adapter 1 consists of an upper extension rod 4 into which a lower extension rod 5 is screwed. The ceiling 2 has a prior art recessed lighting fixture 3 which has a female socket 20. The extension rod 4 consists of an upper male adapter 21, a hollow rod 13, and a female socket 11. A line voltage to low voltage transformer 24 converts the line voltage to the low voltage needed for 12 volt lighting. Male adapter 310 presents two AC line voltage wires to the transformer 24. Wires 22,23 run down the hollow of rod 13 to female socket 11, carrying the low voltage.

The extension rod 5 consists of male adapter 12 which screws into female socket 11. Hollow rod 14 contains wires 22, 23 which power female socket 9 and bulb 10. A plate 6 (same as FIG. 9) connects to rod 14. Brackets 7 support a shroud 8. Design choice can select lengths L1, L2. Designers can place bulb 10 over a pool table or a restaurant table as they choose without the cost of re-wiring and replacing the recessed lighting fixture 3.

Referring next to FIGS. 4–7 an AC system is shown, wherein the designer can lower the height of a standard AC bulb from a standard ceiling fixture.

FIGS. 4,5,6,7 represent AC extension rod 30. Extension rod 30 consists of a male adapter 310, a hollow, non-conductive rod 41, and a female socket 311. Nominally rod 41 can be made of plastic. The male adapter 310 is a conductor having a hollow 50 to receive the rod 41. A screw 47 threads through threaded hole 45 into recess 46, thereby securing the rod 41 via its recess 46. Threads 32 are standard AC bulb socket threads 1 1/16 OD, 7 threads per inch. A conductive button 34 is housed in the center insulator 33. The uninsulated tip 35 of the hot insulated wire 42 is soldered to the conductive button 34 in a known manner. The insulated neutral wire 37 has an uninsulated end 38 which fasten to the conductive male end 31 via screw 40 threaded through hole 39. The pair of insulated wires 37,42 are housed in the hollow 500 of rod 41.

The female end 600 is insulated from conductive button 340 at its base 602 via center insulator 607 in a known manner. Threads 601 receive a standard AC bulb or a male end 31 with threads 32.

Figure 9:
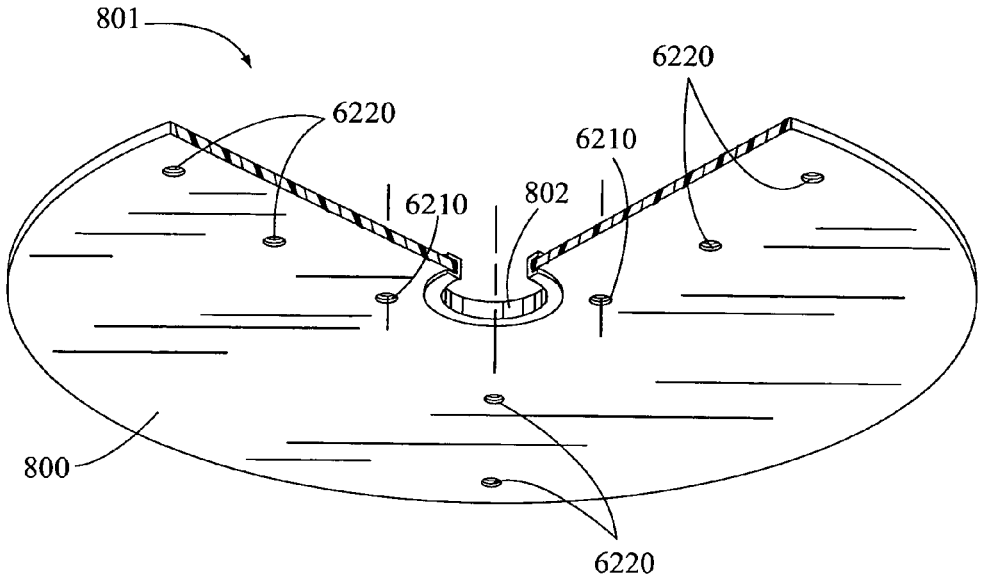
FIG. 9 is a partial cutaway view of a lampshade holder plate.

Holes 620 receive screws 621 thereby fastening a plate or a shroud as seen in FIG. 9.

Figure 7:
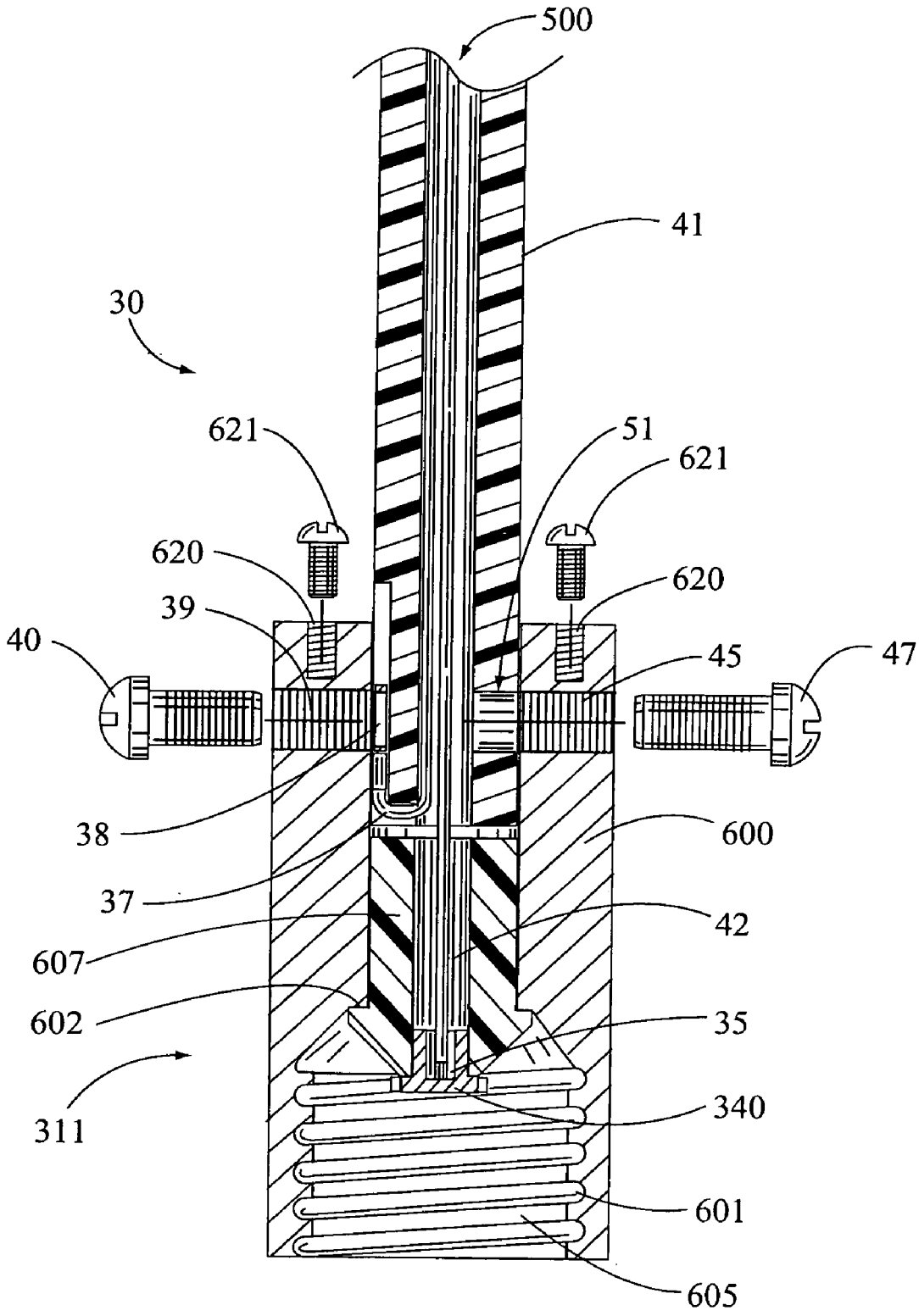
FIG. 7 is a cross sectional view of the female end.

FIG. 9 shows holes 6210 which receive screws 621 of FIG. 7. This plate then accepts the brackets 7 of FIG. 1, via mounting holes 6220 which in turn support shroud 8 of FIG. 1.

Figure 8:
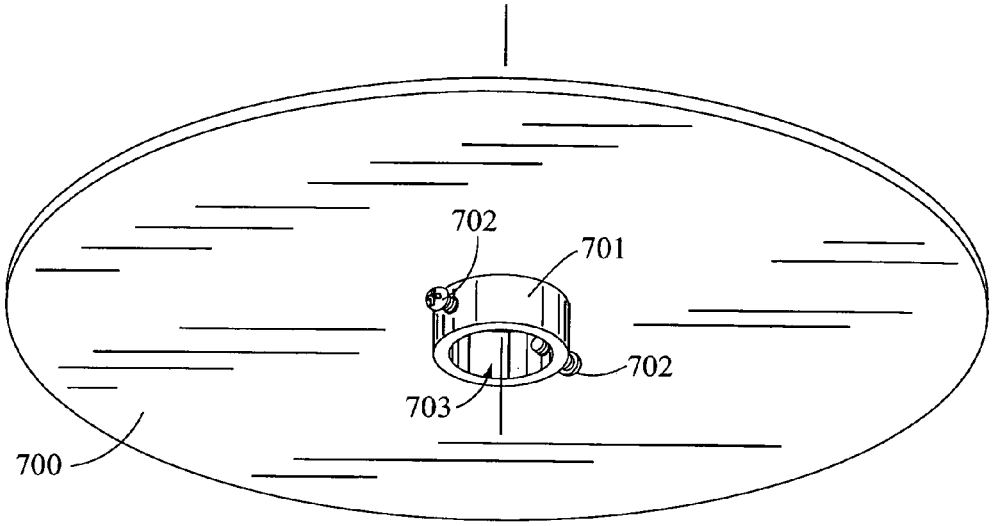
FIG. 8 is a perspective view of a ceiling closeout plate.

The plate 700 in FIG. 8 would normally be mounted with the collar side facing the female end 600 of FIG. 7. The collar 701 would be placed around the rod 41 while it was detached from either the male end 31 or the female end 600. Locking screws 702 can secure the plate 700 anywhere along rod 41, to close out the recessed lighting fixture recess in the ceiling.

Figure 10:
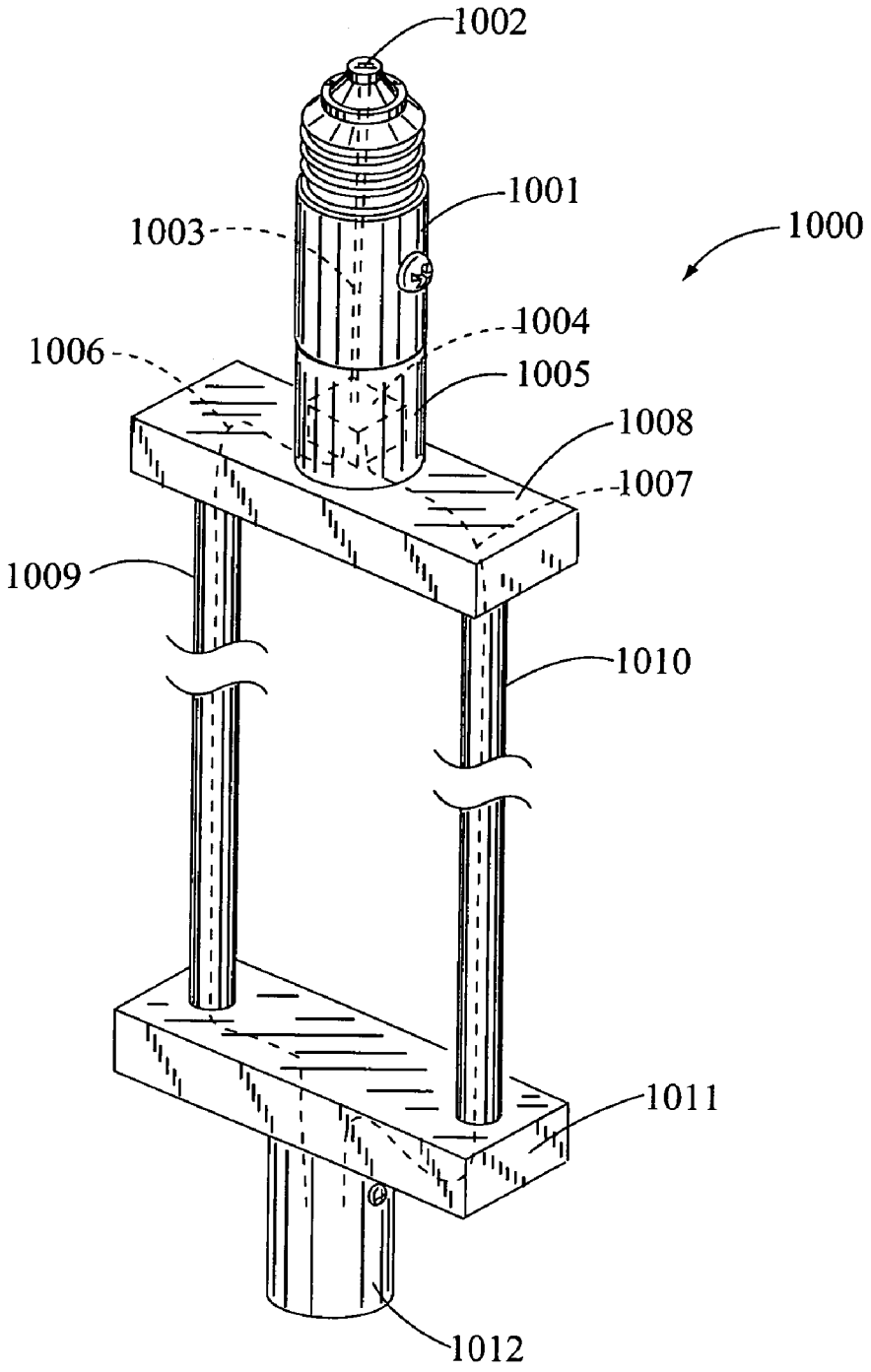
FIG. 10 is a top perspective view of a line voltage to low voltage alternate embodiment.

Referring next to FIG. 10 a line voltage to low voltage extension rod 1000 consists of a male adapter 1001 with a standard contact button 1002. Wires 1003 carry AC voltage to a transformer 1004 housed in a cylindrical housing 1005. Low voltage wires 1006,1007 travel through cross bracket 1008 and then down hollow rods 1009,1010, and then through cross bracket 1011 and into female socket 1012, which would normally hold a 12 volt bulb.

Figure 6:
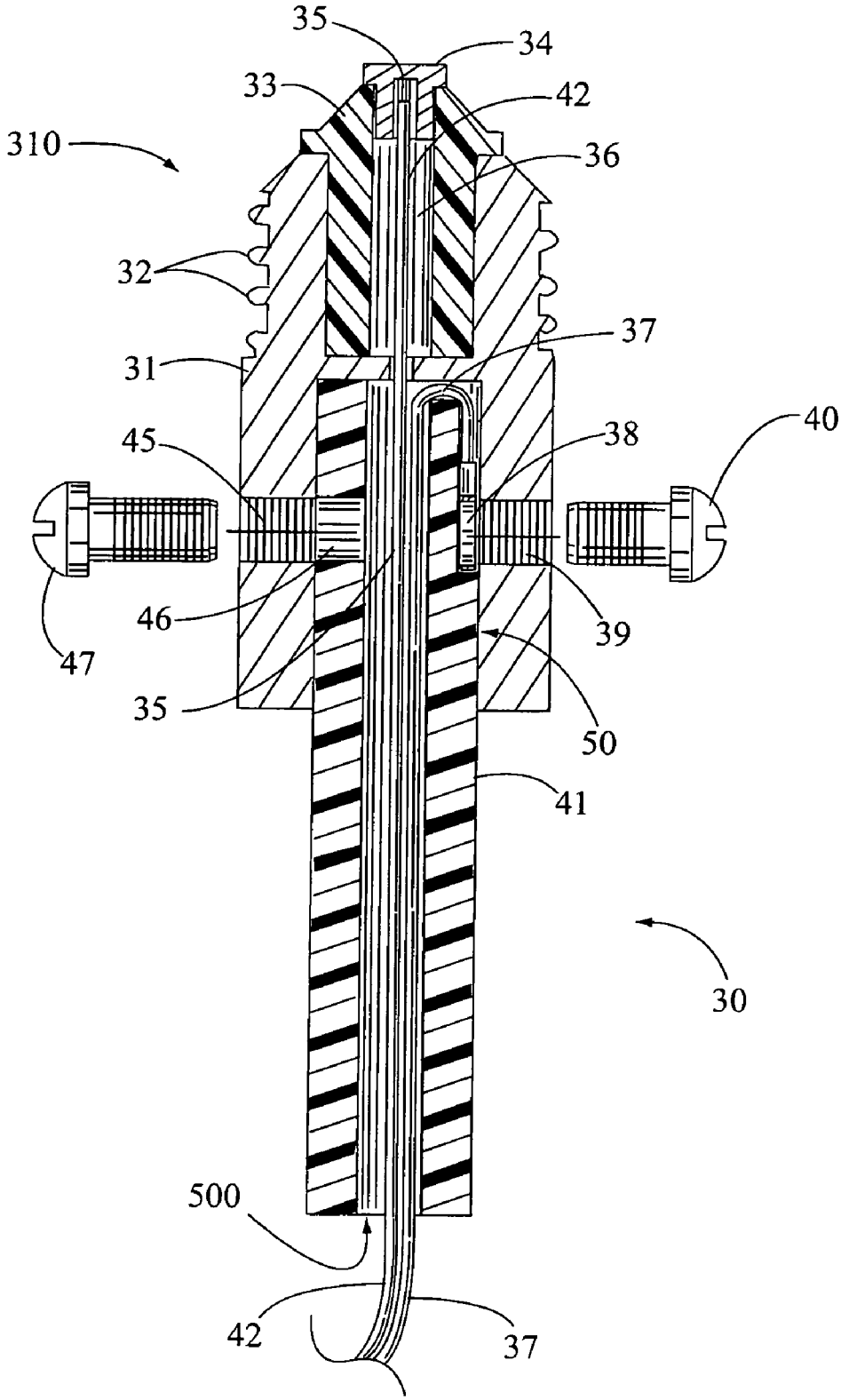
FIG. 6 is a cross sectional view of the male end.
Figure 11:
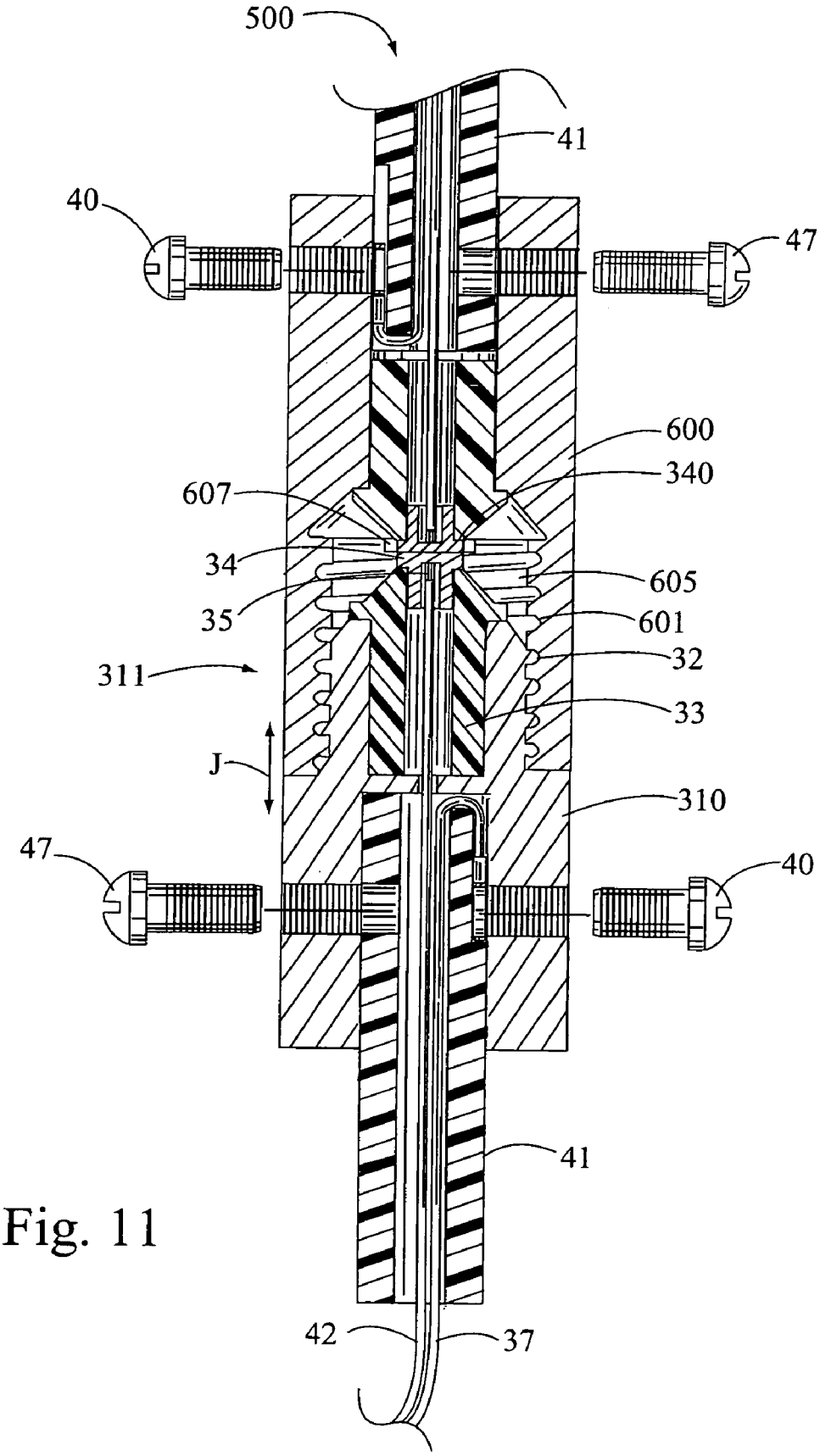
FIG. 11 is a cross sectional view of a mated male end female pair.

Referring next to FIG. 11, the male adapter 310 of FIG. 6 is shown screwed into the female socket 311 of FIG. 7. There is formed a smooth joint J along the exterior mated surfaces of 310 and 311.

Figure 12:
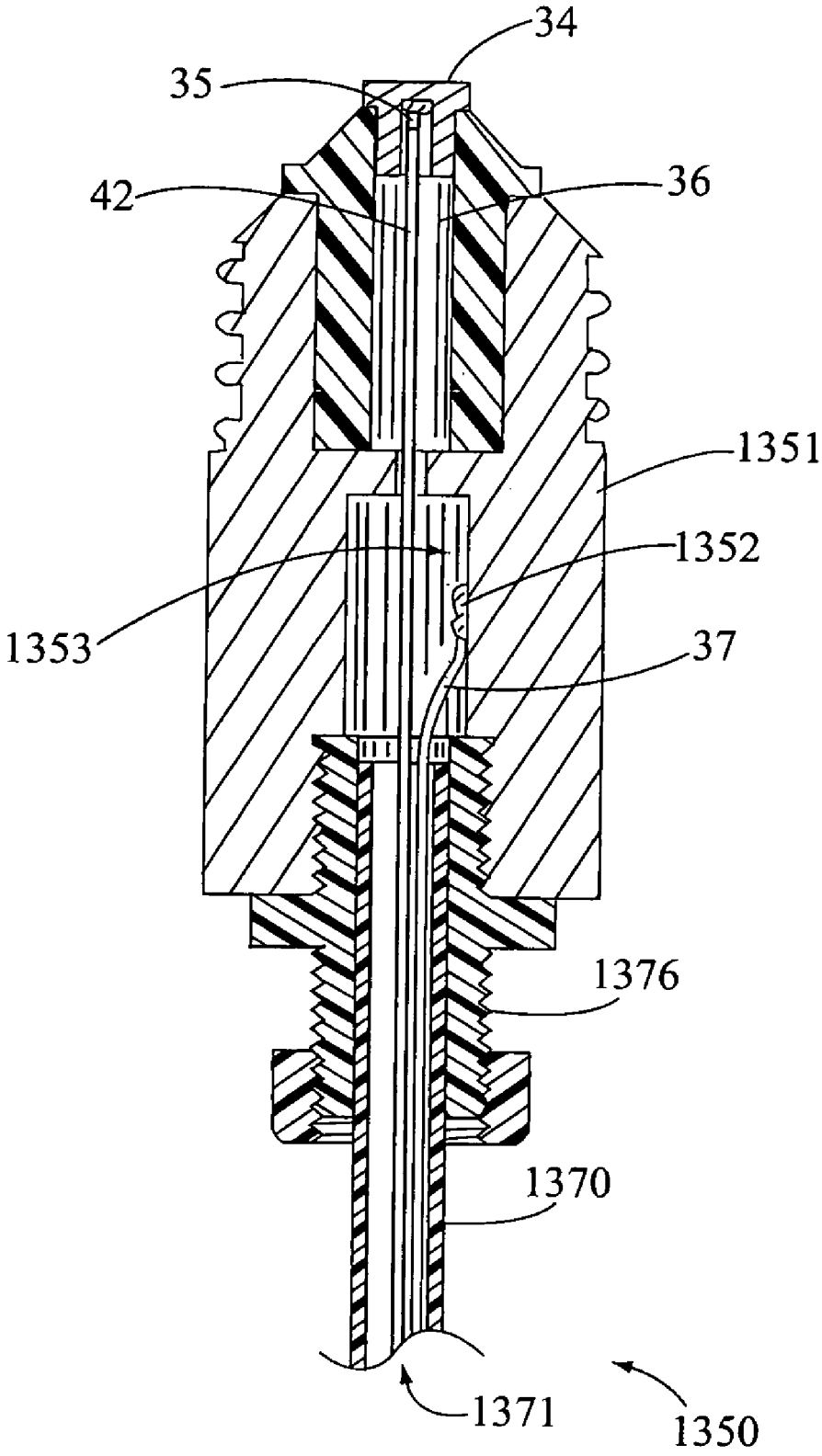
FIG. 12 is a cross sectional view of an alternate flexible embodiment male end.
Figure 13:
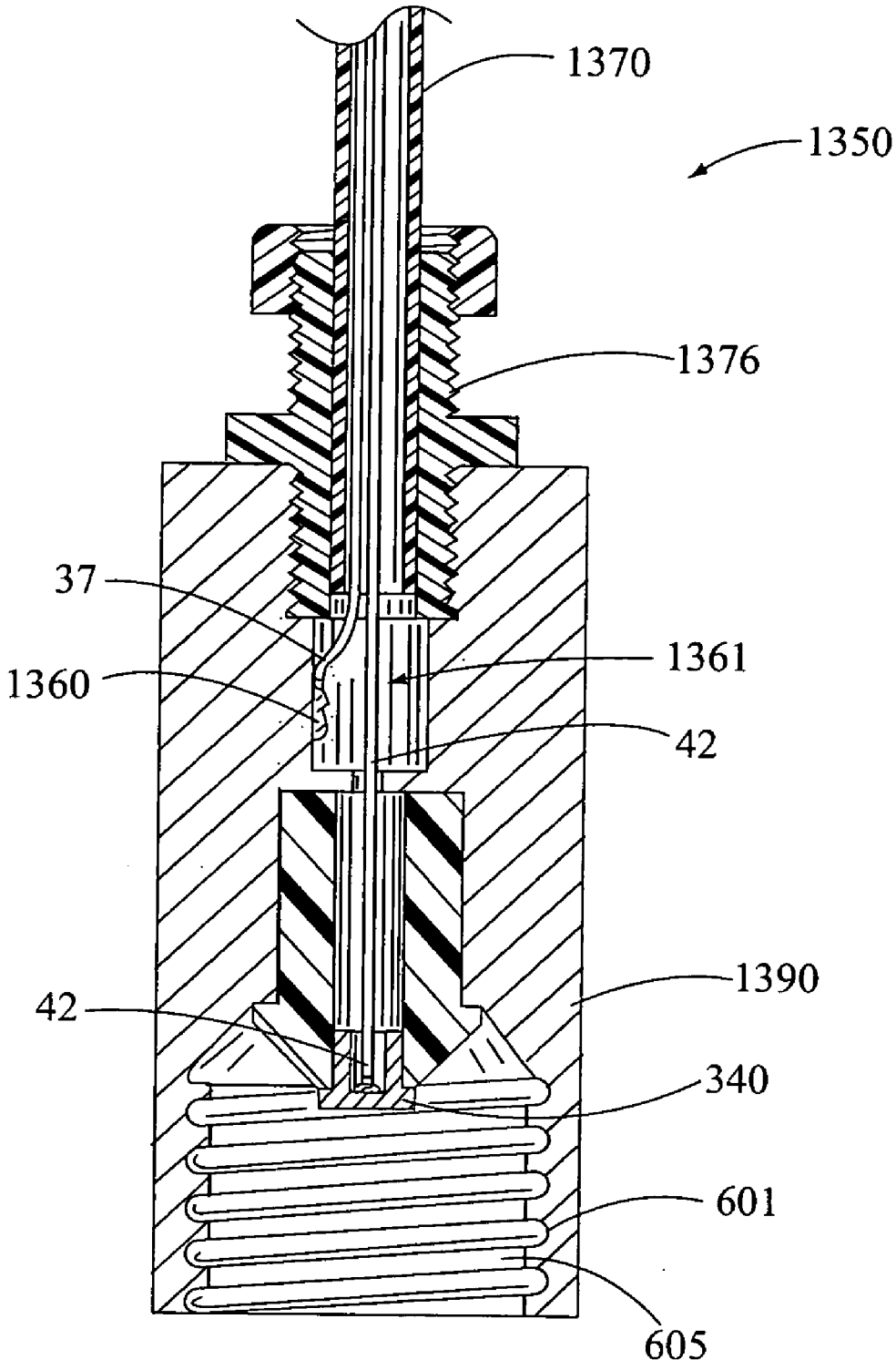
FIG. 13 is a cross sectional view of the female end of the FIG. 12 embodiment.

Referring next to FIGS. 12,13 a two conductor flexible conductor 1350 is shown. The male adapter 1351 has the same contact button 34 as in FIG. 6. However, the neutral wire 37 has a solder connection 1352 to an inside wall of a hollow 1353 of the male adapter 1351.

The cable 1370 has a hollow 1371, and the cable 1370 is flexible, wherein strain relief 1376 can provide structural integrity for the weight of the female socket 1390. Strain relief connectors 1376 secure the cable 1370 to the male/female ends. The solder connection 1360 is in hollow 1361 of female socket 1390.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A first extension adapter for a female electrical socket for a ceiling recessed lighting fixture, said first extension adapter comprising:

a male adapter having a bayonet style threaded end with a conductive button at its tip;

said male adapter with male screw threads and an outside diameter of 1 1/16 inch and having a housing with an internal wire which electrically connects the conductive button to a female adapter via an intermediary cable;

said intermediary cable being connected to the male adapter housing and a female adapter housing;

said female adapter housing further comprising a female socket with female screw threads matching the male screw threads and having an inside diameter of 1 1/16 inch with a conductive button connected to the wire from the male adapter conductive button;

wherein the intermediary cable further comprises a hollowed, non-conductive, rigid rod;

wherein the male adapter housing further comprises a cylindrical shape which conforms to a similar cylindrical shape of the female adapter housing;

wherein the intermediary cable is housed within an opening in the male adapter housing and an opening in the female adapter housing and wherein the female socket of the female adapter housing receives an identical bulb thread as is accepted by the female electrical socket for the ceiling recessed lighting fixture, and provides the female socket at a chosen distance away from the female electrical socket.

2. The adapter of claim 1 further comprising a plate connected to the female housing, said plate supporting a shroud.

3. The adapter of claim 1 further comprising a plate connected to the intermediary cable, said plate supporting a shroud.

4. The adapter of claim 1 further comprising the ceiling plate associated with the male adapter and suited to cover an opening in a recessed lighting fixture.

5. The adapter of claim 4, wherein the plate further comprises a mounting collar with a fastener to secure the plate to the intermediary cable.

6. The adapter of claim 1 further comprising a neutral wire connected from the male adapter housing to the female adapter housing via the intermediary cable.

7. The adapter of claim 1 further comprising a second extension adapter screwed into the female adapter, said second extension adapter having a male bayonet style threaded end with a conductive button at its tip and a distal end with a female adapter, said threaded ends of said second extension adapter having the same outside diameters as the first extension adapter.

8. The adapter of claim 1, wherein the intermediary cable is removably attached to the male adapter and the female adapter housings.

9. The adapter of claim 8, wherein the male and female adapter housings each use a screw to removably secure the intermediary cable.

10. The adapter of claim 1, wherein each of the male and female adapter housings have a center insulator supporting their respective conductive buttons.

* * * * *